US006719668B1

(12) United States Patent
Huang

(10) Patent No.: US 6,719,668 B1
(45) Date of Patent: Apr. 13, 2004

(54) TREADMILL OPERATION MODE CONTROL SYSTEM

(76) Inventor: Ping-Hui Huang, No. 23, 15th Road, Ta Li Industrial Park, Taiping City, Taichung Hsien (TW)

( * ) Notice: Subject to any disclaimer, the term of this patent is extended or adjusted under 35 U.S.C. 154(b) by 0 days.

(21) Appl. No.: 10/330,261

(22) Filed: Dec. 30, 2002

(51) Int. Cl.[7] ..... A63B 23/00
(52) U.S. Cl. ..... 482/54; 482/3; 482/6
(58) Field of Search ..... 482/54, 1–10, 482/900–903

(56) References Cited

U.S. PATENT DOCUMENTS 1,919,627 A * 7/1933 Fitzgerald ..... 482/7
4,708,337 A * 11/1987 Shyu ..... 482/54
5,314,391 A * 5/1994 Potash et al. ..... 482/7
5,690,587 A * 11/1997 Gruenangerl ..... 482/54
5,800,314 A * 9/1998 Sakakibara et al. ..... 482/54

* cited by examiner

*Primary Examiner*—Stephen R. Crow
(74) *Attorney, Agent, or Firm*—Rosenberg, Klein & Lee

(57) ABSTRACT

A treadmill operation mode control system for use in a treadmill is disclosed include two ultrasonic transmitter receiver units respectively installed in the upright support of the base frame of the treadmill at two sides, and a microprocessor electrically connected between the ultrasonic transmitter receiver units and the instrument panel of the treadmill and adapted to accelerate the speed of the treadbase motor of the treadmill when the user moving a part of the body toward one ultrasonic transmitter receiver unit, or to reduce the speed of the treadbase motor when the user moving a part of the body toward the other ultrasonic transmitter receiver unit.

2 Claims, 5 Drawing Sheets

TREADMILL OPERATION MODE CONTROL SYSTEM

BACKGROUND OF THE INVENTION

1. Field of the Invention

The present invention relates to treadmills and, more specifically, to a treadmill operation mode control system, which enables the user to control the speed of the treadbase motor (or the angle of inclination of the treadbase) by moving the left or right hand without touching any part of the treadmill when treading.

2. Description of the Related Art

A variety of motor-driven treadmills have been disclosed, and have appeared on the market. Regular motor-driven treadmills commonly use a treadbase motor to rotate an endless belt upon which the user treading, and an instrument panel for operation control. When treading upon the endless belt, the user may need to change the speed. In this case, the user shall have to operate the instrument panel. However, it is difficult to keep the body in balance when lowering the head to watch the instrument panel and operating the instrument panel with one hand during treading.

There are known motor-driven treadmills with infrared control, which enables the user to control the speed of the treadbase motor without touching the instrument panel while during exercise. However, the infrared signal tends to be interfered with external noises, such as the light of a lamp or the sun.

Further, regular treadmills allow the user to adjust the angle of inclination of the treadbase. However, when wishing to adjust the angle of inclination of the treadbase, the user must stop exercising. A motor-driven treadmill enables the user to adjust the angle of inclination of the treadbase through the instrument panel. However, the user must move toward the instrument panel during exercising when wishing to adjust the angle of inclination of the treadbase.

Therefore, it is desirable to provide treadmill operation mode control system that eliminates the aforesaid drawbacks.

SUMMARY OF THE INVENTION

The present invention has been accomplished under the circumstances in view. It is therefore the main object of the present invention to provide a treadmill operation mode control system, which enables the user to control the speed of the treadbase motor by moving the left or right hand without touching any part of the treadmill when treading. It is another object of the present invention to provide treadmill operation mode control system, which enables the user to control the angle of inclination of the treadbase by moving the left or right hand without touching any part of the treadmill when treading. It is still another object of the present invention to provide a treadmill operation mode control system, which is free from the interference of external light. It is still another object of the present invention to provide a treadmill operation mode control system, which enables the user to control the operation of the treadmill either through the instrument panel or by means of moving the hand. According to one embodiment of the present invention, the treadmill operation mode control system comprises two ultrasonic transmitter receiver units respectively installed in the upright support of the base frame of the treadmill at two sides, and a microprocessor electrically connected between the ultrasonic transmitter receiver units and the instrument panel of the treadmill and adapted to accelerate the speed of the treadbase motor of the treadmill when the user moving a part of the body toward one ultrasonic transmitter receiver unit, or to reduce the speed of the treadbase motor when the user moving a part of the body toward the other ultrasonic transmitter receiver unit. In an alternate form of the present invention, the ultrasonic transmitter and receiver units are adapted to control forward/backward rotation of an inclining motor, that drives a transmission mechanism to lift/lower the front side of the treadbase so as to further adjust the angle of inclination of the treadbase.

DETAILED DESCRIPTION OF THE PREFERRED EMBODIMENT

Figure 1:
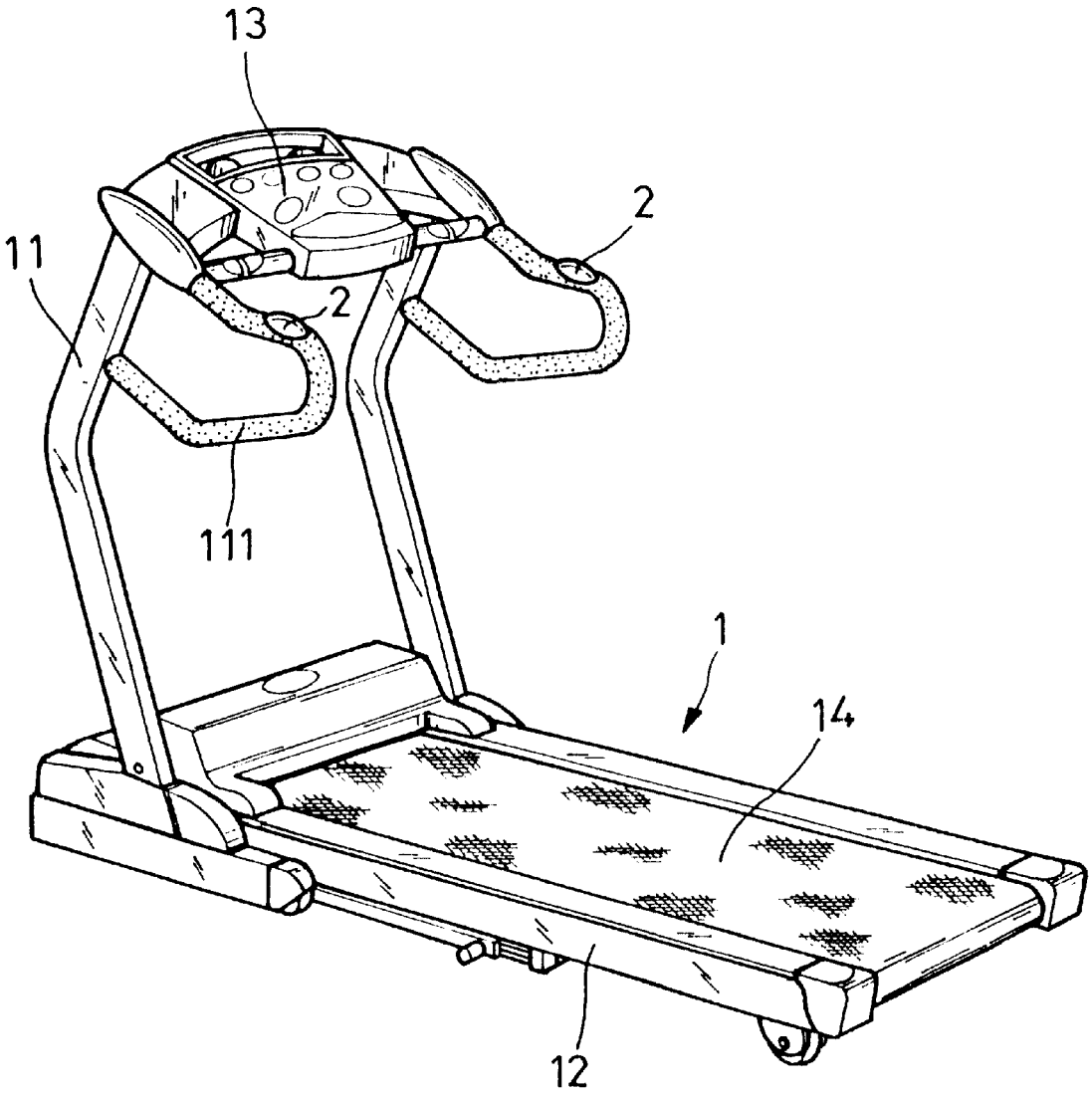
FIG. 1 is an elevational view of a treadmill constructed according to the present invention.

Referring to FIGS. 1~5, a treadmill 1 is shown comprising a base frame 11, treadbase 12 fastened pivotally with the base frame 11, a motor 15 mounted inside the base frame 11 and adapted to rotate the endless belt 14 of the treadbase 12, two handlebars 111 bilaterally located on the (front upright support of the) base frame 11 near the top and spaced above the pivoted front side of the treadbase 12 at a distance, and an instrument panel 13 located on the top of the base frame 11 above the handlebars 111.

Figure 4:
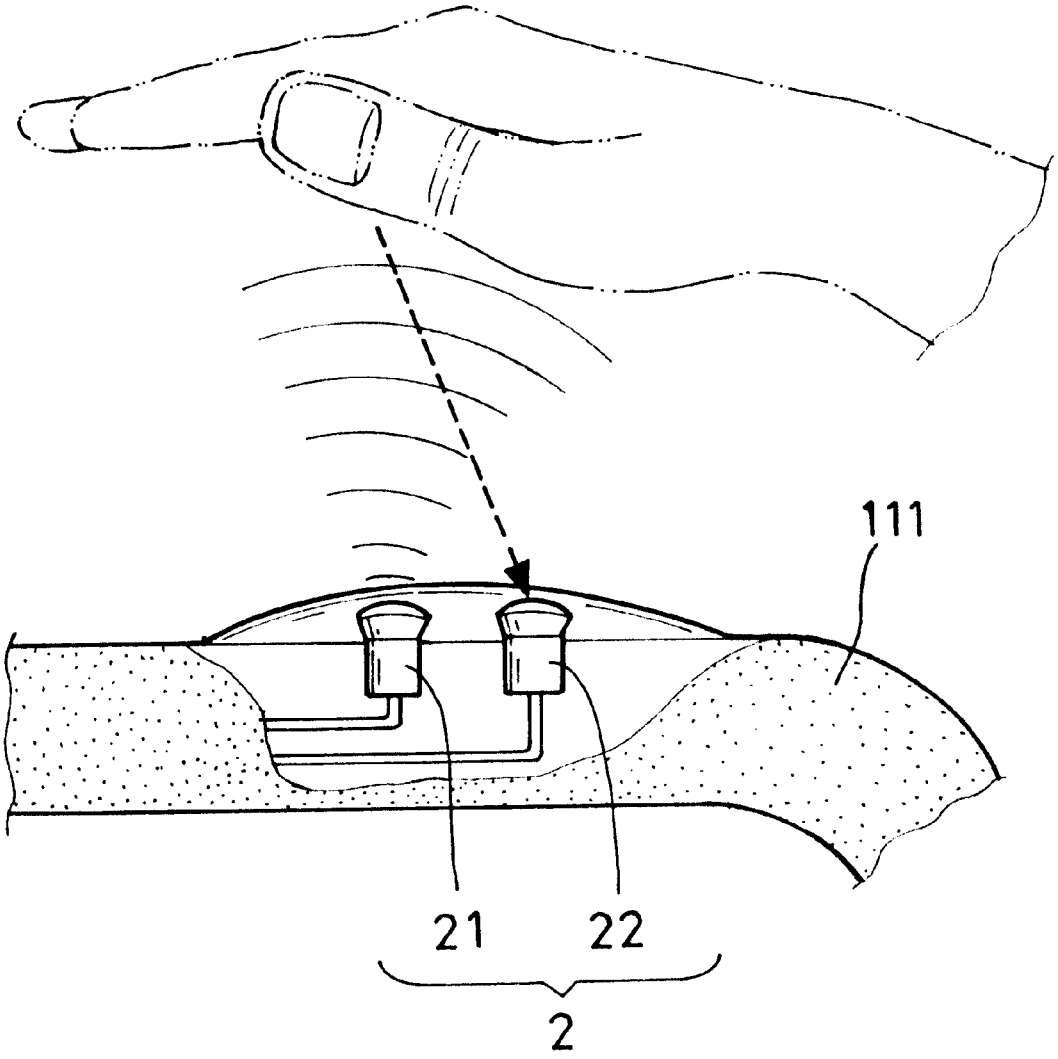
FIG. 4 is a schematic drawing showing the user reflected the ultrasonic signal from the ultrasonic transmitter upon the ultrasonic receiver.
Figure 5:
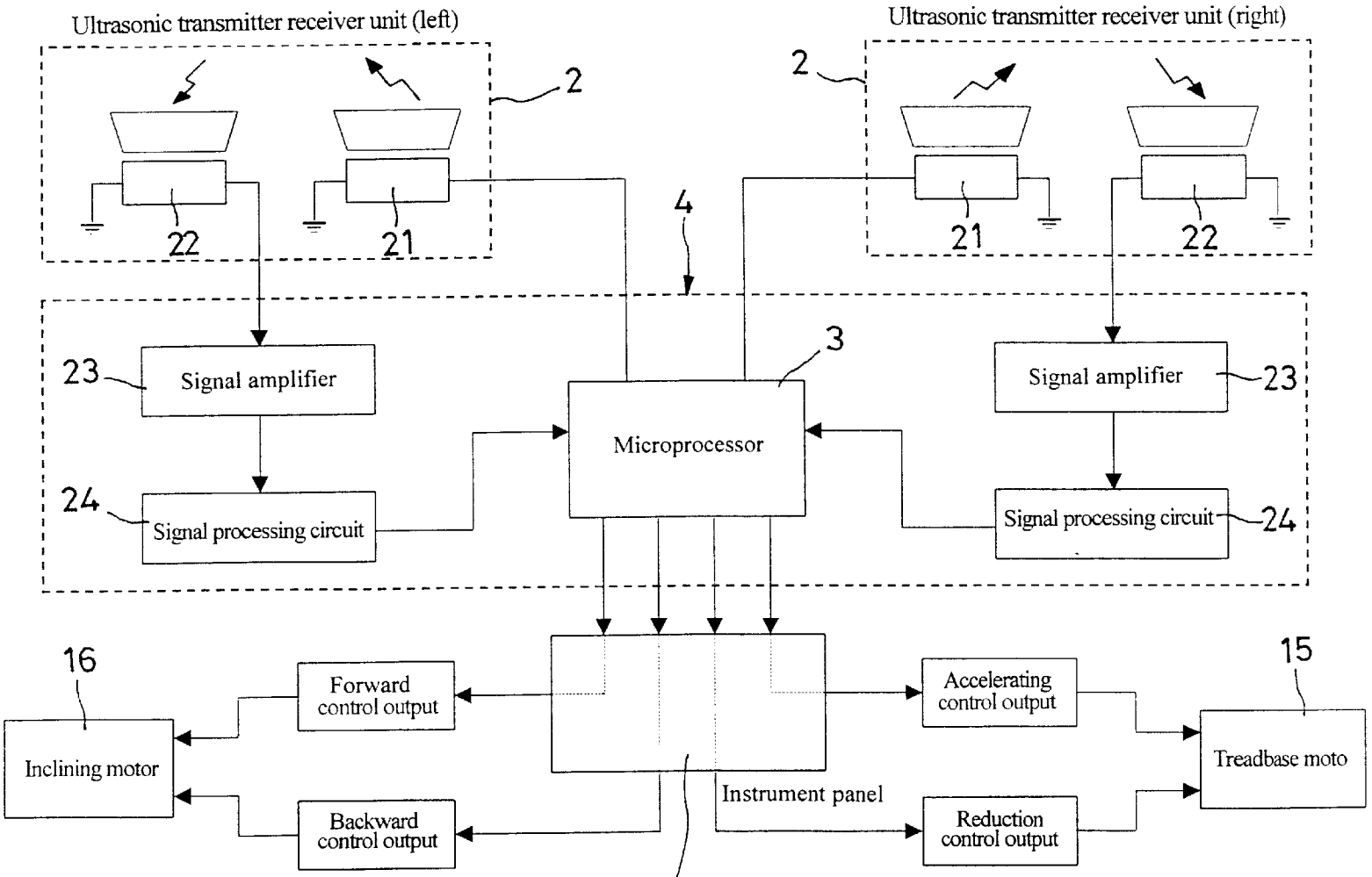
FIG. 5 is a control block diagram according to the present invention.

Two ultrasonic transmitter receiver units 2 are respectively installed in the handlebars 111, and electrically connected to the instrument panel 13 through a microprocessor 3. As illustrated in FIGS. 4 and 5, each ultrasonic transmitter receiver unit 2 is comprised of a ultrasonic transmitter 21, a ultrasonic receiver 22, a signal amplifier 23, and a signal processing circuit 24. The ultrasonic transmitter 21 emits a ultrasonic signal. When the ultrasonic signal stopped and reflected by the a part of the body of the user, the ultrasonic receiver 22 receives the reflected ultrasonic signal, and then sends the reflected ultrasonic signal to the microprocessor 3 through the signal amplifier 23 and the signal processing circuit 24, thereby causing the microprocessor 3 to control the speed of the motor 15. According to this embodiment, the ultrasonic transmitter receiver units 2 are reversed, i.e., one for accelerating the speed of the motor 15 and the other for reducing the speed of the motor 15.

Referring to FIG. 5 again, the amplifiers 23, the signal processing circuits 24 and the microprocessor 3 are integrated in a circuit board, forming a control circuit 4. The control circuit 4 can be installed in any suitable location in the treadmill 1, for example, inside the instrument panel 13. Thus, the motor 15 can be controlled either through the instrument panel 13 or the control circuit 4.

Figure 2:
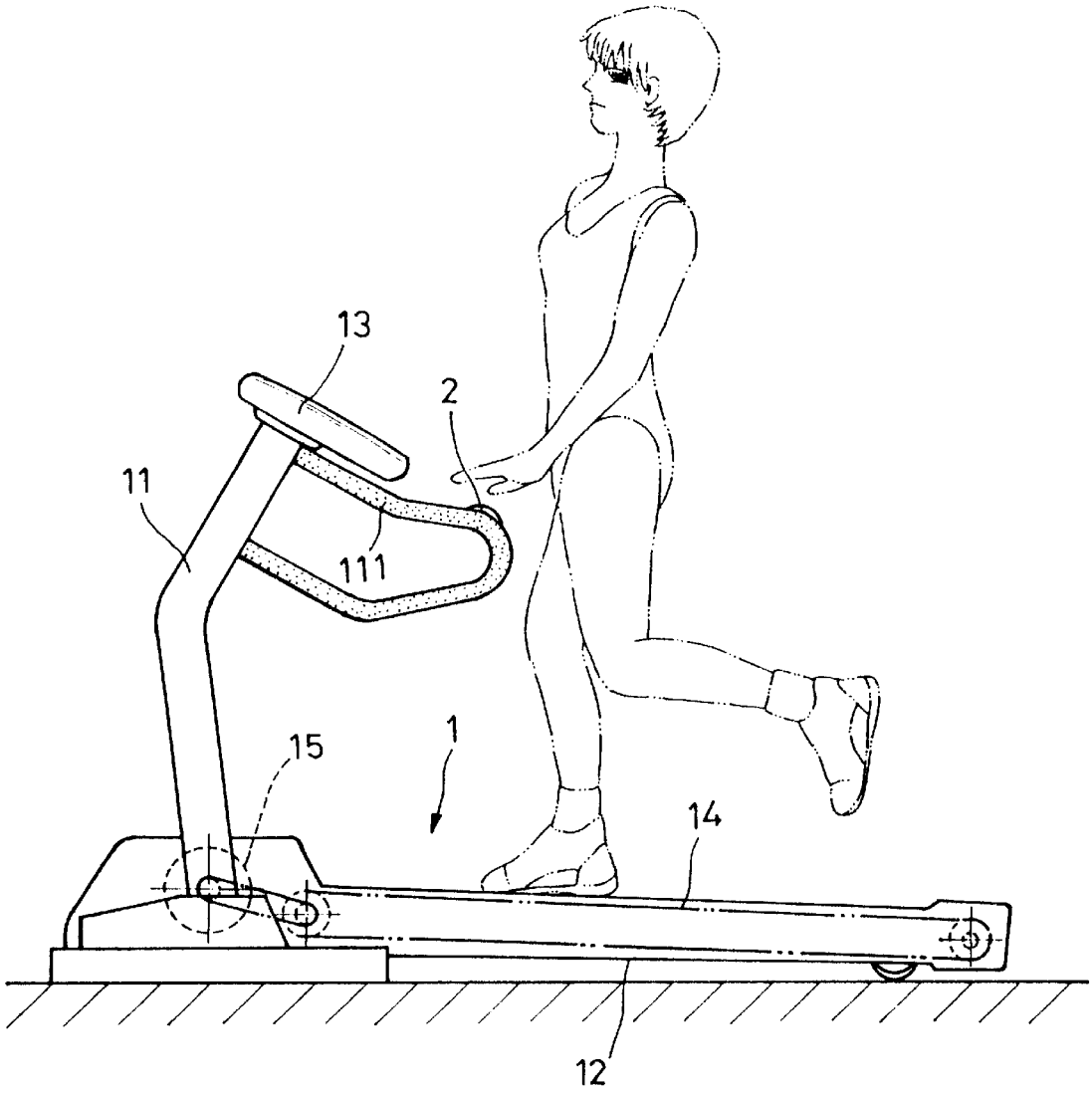
FIG. 2 is a schematic side view showing a treadbase motor speed control action according to the present invention.

With reference to FIGS. 2, 4, and 5, when the user treading upon the endless belt 14 of the treadbase 12, he (she) can move the left hand/right hand toward the left/right ultrasonic transmitter receiver unit 2 to reflect the ultrasonic signal of the corresponding ultrasonic transmitter 21 upon the corresponding ultrasonic receiver 22, thereby causing the microprocessor 13 to accelerate/reduce the speed of the motor 15. When accelerating or reducing the speed of the motor 15, the instrument panel 13 shows the adjustment of the speed value of the motor 15.

Because the control circuit 4 is electrically connected to the instrument panel 13, the user can set the speed of the motor 15 through the instrument panel 13, or adjust the speed of the motor 15 through the ultrasonic transmitter receiver units 2.

Figure 3:
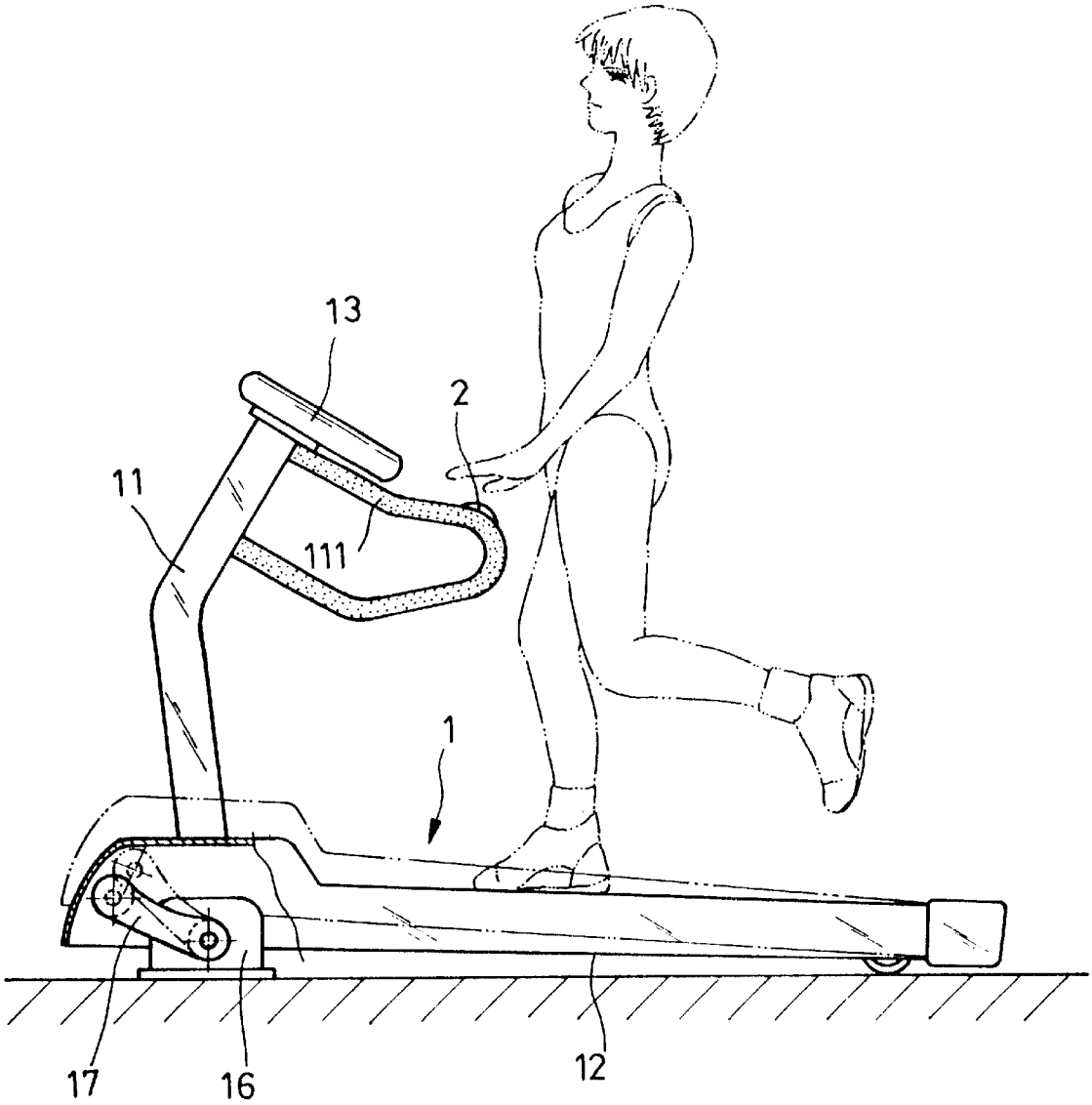
FIG. 3 is a schematic side view showing an inclining motor control action according to the present invention.

With reference to FIGS. 3, 4, and 5, as an alternate form of the present invention, the ultrasonic transmitter receiver units 2 can be set to control the angle of inclination of the treadbase 12. In this case, an inclining motor 16 is installed in the base frame 11, and a transmission mechanism 17 is coupled between the inclining motor 16 and the front side of the treadbase 12. When the user approached the left/right ultrasonic transmitter receiver unit 2, the inclining motor 16 is controlled to rotate forwards/backwards, thereby causing the transmission mechanism 17 to lift/lower the front side of the treadbase 12, and therefore the angle of inclination of the treadbase 12 is adjusted as desired.

A prototype of treadmill operation mode control system has been constructed with the features of FIGS. 1~5. The treadmill operation mode control system functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A treadmill operation mode control system used in a treadmill comprising a base frame having a front upright support, a treadbase fastened pivotally with said base frame and carrying an endless belt, a treadbase motor adapted to rotate said endless belt, and an instrument panel mounted on a top side of the front upright support of said base frame, the treadmill operation mode control system comprising:

a first ultrasonic transmitter receiver unit installed in a left side of the upright support of said base frame, said first ultrasonic transmitter receiver unit comprising a ultrasonic transmitter adapted to emit a first ultrasonic signal, and a ultrasonic receiver adapted to receive said first ultrasonic signal and to output a corresponding control signal when the user of said treadmill moving a part of the body toward said first ultrasonic transmitter receiver unit to reflect said first ultrasonic signal;

a second ultrasonic transmitter receiver unit installed in a right side of the upright support of said base frame, said first ultrasonic transmitter receiver unit comprising a ultrasonic transmitter adapted to emit a second ultrasonic signal, and a ultrasonic receiver adapted to receive said second ultrasonic signal and to output a corresponding control signal when the user of said treadmill moving a part of the body toward said second ultrasonic transmitter receiver unit to reflect said second ultrasonic signal; and a microprocessor electrically connected in between said first and second ultrasonic transmitter receiver units and said instrument panel and adapted to receive the control signal from said first ultrasonic transmitter receiver unit and the control signal from said second ultrasonic transmitter receiver unit and to accelerate/reduce the speed of said treadbase motor subject to the control signal.

2. The treadmill operation mode control system as claimed in claim 1 further comprising an inclining motor, and a transmission mechanism controlled by said inclining motor to lift/lower said treadbase and to change the angle of inclination of said treadbase.

* * * * *